US012096836B1

(12) United States Patent
Yang

(10) Patent No.: US 12,096,836 B1
(45) Date of Patent: Sep. 24, 2024

(54) CARTRIDGE CORE ASSEMBLY AND COSMETIC CONTAINER COMPRISING CARTRIDGE CORE ASSEMBLY

(71) Applicant: SHYA HSIN PACKAGING INDUSTRY (CHINA) CO., LTD., Jiangsu (CN)

(72) Inventor: Haiying Yang, Jiangsu (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 18/542,806

(22) Filed: Dec. 18, 2023

(30) Foreign Application Priority Data

Mar. 20, 2023 (CN) ..... 202310272466.6

(51) Int. Cl.
*A45D 40/04* (2006.01)
*A45D 40/06* (2006.01)

(52) U.S. Cl.
CPC ..... *A45D 40/04* (2013.01); *A45D 40/06* (2013.01)

(58) Field of Classification Search
CPC ..... A45D 40/00; A45D 40/02; A45D 40/04; A45D 40/06; A45D 40/12; A45D 40/20; A45D 2040/208
USPC ..... 401/68, 75, 87, 172, 174
See application file for complete search history.

(56) References Cited

U.S. PATENT DOCUMENTS 6,474,891 B1 * 11/2002 Liu ..... B43K 8/04 401/172
6,793,431 B1 * 9/2004 Tsai ..... A45D 40/262 401/172

* cited by examiner

*Primary Examiner* — David J Walczak

(57) ABSTRACT

A cartridge core assembly comprises a cartridge, a screw barrel, a guide member, an elastic member, and a nut, the cartridge is fixedly connected to the guide member, the screw barrel and the nut are screwed to each other, and the elastic member is sleeved on the nut in a circumferentially fixed manner; the guide member is provided with a plurality of first engagement teeth, the elastic member is provided with a plurality of second engagement teeth, and each tooth of at least one of the first engagement teeth and the second engagement teeth comprises a bottom surface, a first beveled surface and a second beveled surface; and an angle between the first beveled surface and the bottom surface is $\alpha_1$, an angle between the second beveled surface and the bottom surface is $\alpha_2$, and the $\alpha_1$ and the $\alpha_2$ are different acute angles.

20 Claims, 17 Drawing Sheets

CARTRIDGE CORE ASSEMBLY AND COSMETIC CONTAINER COMPRISING CARTRIDGE CORE ASSEMBLY

CROSS REFERENCE TO RELATED APPLICATIONS

The present application claims the benefit of Chinese Patent Application No. 202310272466.6 filed on Mar. 20, 2023, the contents of which are incorporated herein by reference in their entirety.

TECHNICAL FIELD

The present application relates to cosmetic package technology, and in particular to a cartridge core assembly and a cosmetic container comprising the cartridge core assembly.

BACKGROUND ART

At present, cosmetics have become an indispensable part of people's daily life. In view of the purpose of ease of carrying and use, cosmetics are all packaged in cosmetic containers before leaving the factory. In order to meet the package needs of different forms of cosmetics, cosmetic containers are in various forms of a box, tube, a bag, etc., and a cartridge core is the most important part of a container in the form of a tube, and the cartridge core comprises a cartridge, a piston, a screw and a nut, wherein during rotation of the nut, the screw and piston are driven to reciprocate in the cartridge. At present, the cartridge core can be arbitrarily rotated forward and reversely. Therefore, a user has a single hand feeling when using a product, and the product is unattractive.

SUMMARY OF THE INVENTION

In order to overcome the above defects, the present application provides a cartridge core assembly, wherein the cartridge core assembly is provided with a plurality of first engagement teeth and a plurality of second engagement teeth that mesh with each other. During use, the purpose of generating different resistance forces during forward and reverse rotation is achieved by means of the cooperation between the first engagement teeth and the second engagement teeth, which improves the hand feeling when using a product and thus enhances the grade of the product.

In order to solve the above technical problem, the present application adopts the following technical solutions:

a cartridge core assembly comprises a cartridge, a screw barrel, a guide member, an elastic member, and a nut, wherein the cartridge is fixedly connected to the guide member, the screw barrel and the nut are screwed to each other, and the elastic member is sleeved on the nut in a circumferentially fixed manner; the guide member comprises a plurality of first engagement teeth, the elastic member comprises a plurality of second engagement teeth that mesh with the first engagement teeth, and each tooth of at least one of the first engagement teeth and the second engagement teeth comprises a bottom surface, a first beveled surface and a second beveled surface; and an angle between the first beveled surface and the bottom surface is $\alpha_1$, an angle between the second beveled surface and the bottom surface is $\alpha_2$, and the $\alpha_1$ and the $\alpha_2$ are both acute angles and the $\alpha_1$ is not equal to the $\alpha_2$.

Optionally, the first engagement teeth have the same structure as the second engagement teeth, each of the first beveled surface and the second beveled surface has a planar or curved upper surface, and the $\alpha_1$ is less than the $\alpha_2$.

Optionally, when the first engagement teeth mesh with the second engagement teeth, the first beveled surfaces of the first engagement teeth are abutted against the first beveled surfaces of the second engagement teeth, and the second beveled surfaces of the first engagement teeth are abutted against the second beveled surfaces of the second engagement teeth; and when a cosmetic material is screwed out, the first beveled surfaces of the second engagement teeth slide along the first beveled surfaces of the first engagement teeth and gradually disengage therefrom, or when a cosmetic material is screwed out, the second beveled surfaces of the second engagement teeth slide along the second beveled surfaces of the first engagement teeth and gradually disengage therefrom.

Optionally, the first engagement teeth are arranged uniformly and contiguously in a circumferential direction of the guide member, and the second engagement teeth are arranged uniformly and spaced apart in a circumferential direction of the elastic member.

Optionally, the number of first engagement teeth is N times the number of second engagement teeth, or the number of second engagement teeth is N times the number of first engagement teeth, wherein N is an integer from 1 to 10.

Optionally, six first engagement teeth are provided and three second engagement teeth are provided, or three first engagement teeth are provided and six second engagement teeth are provided.

Optionally, the screw barrel comprises a screw and a piston that are fixedly connected, and the screw and the piston are of an integrally molded part, or the screw and the piston are separate parts. Optionally, the first engagement teeth are arranged on an inside wall of the guide member; or the guide member comprises a ratchet ring, the first engagement teeth are arranged on a lower end face of the ratchet ring, and the ratchet ring is fixedly mounted on the inside wall of the guide member by means of a rib.

Optionally, the elastic member comprises an engagement ring and a spring, the second engagement teeth are arranged on an upper end face of the engagement ring, the engagement ring is mounted on the nut by means of a rib in a circumferentially fixed manner, the engagement ring and the spring are an integrally molded plastic part, or the engagement ring and the spring are separate parts, and the spring is sleeved on the nut.

The present application further provides a cosmetic container, comprising a cartridge core assembly as described, a cap assembly, and a base assembly, wherein the cartridge core assembly is mounted in the base assembly such that the base assembly is able to drive the nut to rotate, and the cap assembly removably covers the base assembly.

The beneficial effects of the present application are as follows. The cartridge core assembly in the present application comprises a cartridge, a screw barrel, a guide member, an elastic member, and a nut, wherein the cartridge is fixedly connected to the guide member, the screw barrel and the nut are screwed to each other, and the elastic member is sleeved on the nut in a circumferentially fixed manner; and the guide member is provided with a plurality of first engagement teeth, the elastic member is provided with a plurality of second engagement teeth that mesh with the first engagement teeth, and the first engagement teeth and the second engagement teeth are provided with first beveled surfaces and second beveled surfaces, thereby ensuring that the nut can be rotated both clockwise and counterclockwise, and the first beveled surface and the second beveled surface have different slopes, so that the resistance forces to the nut are different when rotating clockwise and counterclockwise, so as to meet the different requirements of customers. The cartridge core assembly has relatively few components and a simple structure, which reduces the manufacturing cost and assembling difficulty of a product. By means of the cooperation between the first engagement teeth on the guide member and the second engagement teeth on the elastic member, a regular bouncing hand feeling can be brought during use, which is easy to operate and control, and different resistance forces are produced during the processes of screwing out and retracting a cosmetic material, which improves the hand feeling when using the product and thus enhances the grade of the product.

Figure 1:
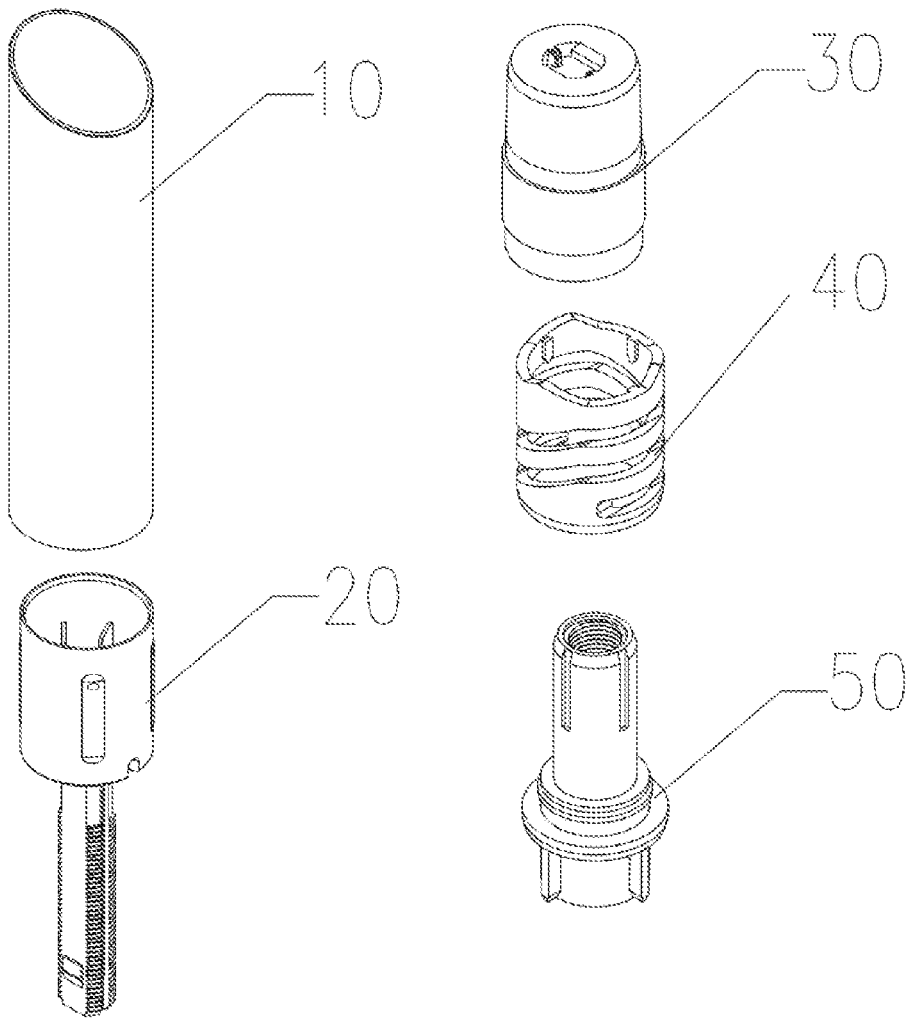
FIG. 1 is an exploded view of a cartridge core assembly in Embodiment 1 of the present application.

In the figures: 10: cartridge, 20: screw barrel, 21: screw, 22: piston, 30: guide member, 31: ratchet ring, 32: first engagement tooth, 33: first beveled surface, 34: second beveled surface, 40: elastic member, 41: engagement ring, 42: second engagement tooth, 43: spring, 50: nut, 60: cap assembly, 61: outer cap, 62: inner cap, 63: first vertical weight, 70: base assembly, 71: outer base, 72: inner base, 73: second vertical weight, 74: outer center ring, 75: inner center ring, 76: cosmetic material.

DETAILED DESCRIPTION OF EMBODIMENTS

The technical solutions in the embodiments of the present application will be clearly and completely described below with reference to the embodiments of the present application. Apparently, the embodiments described are merely some rather than all of the embodiments of the present application. On the basis of the embodiments of the present application, all other embodiments obtained by a person of ordinary skill in the art without involving any inventive effort shall fall within the scope of protection of the present application.

It should be noted that a term such as "first" or "second" in the description and the claims of the present application as well as the following drawings is used to distinguish similar objects, rather than to describe a specific sequence or order. It should be understood that the objects used in such a way is interchangeable in proper circumstances, so that the embodiments of the present application described herein can be implemented in an order other than the order illustrated or described herein. In addition, the terms "comprise" and "have" and any variations thereof are intended to cover a non-exclusive inclusion, for example, a process, a method, a system, a product or a device including a series of steps or units is not necessarily limited to the steps or units explicitly listed, but can include other steps or units that are not explicitly listed or inherent to the process, the method, the product or the device.

For ease of description, spatial relative terms such as "over", "above", "on an upper surface" and "on" may be used herein to describe spatial positional relations of one device or feature with other devices or features as shown in the drawings. It should be understood that the spatial relative terms are intended to comprise different orientations in use or operation in addition to the orientation of the device described in the drawings. For example, if the device in the drawings is inverted, the device described as "above" or "over" other devices or structures would then be positioned "below" or "under" the other devices or structures. Thus, the exemplary term "above" may comprise two orientations of "above" and "below". The device may also be positioned (rotated 90 degrees or at other orientations) in other different ways and the spatial relative description used herein is interpreted accordingly.

Figure 13:
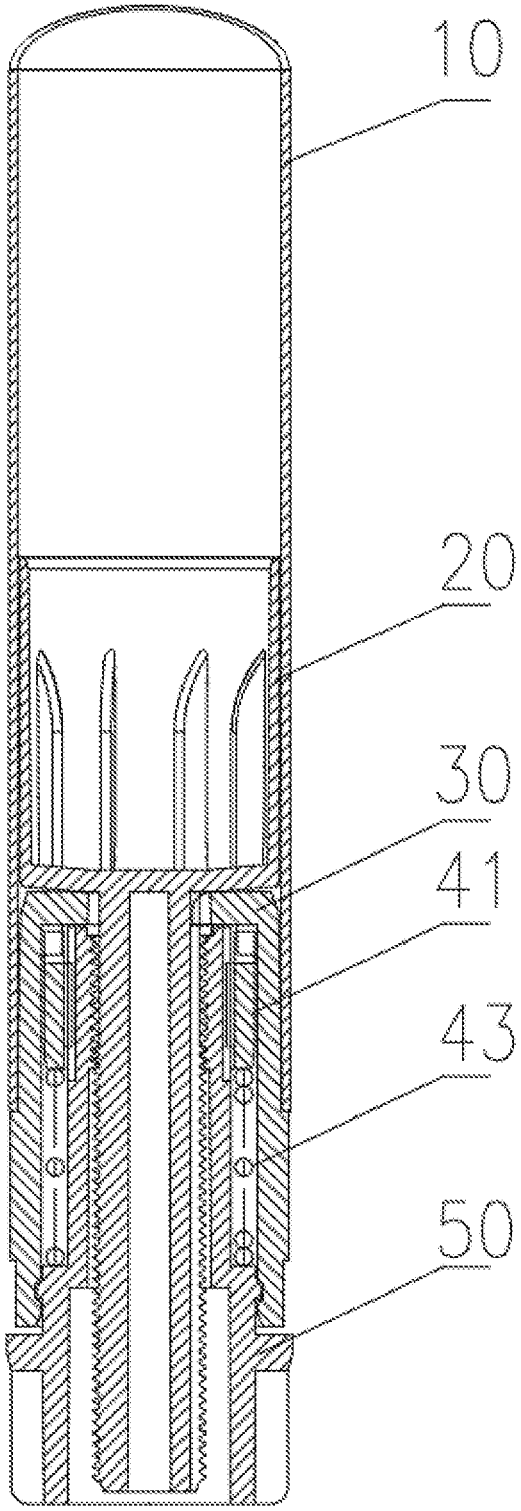
FIG. 13 is a second schematic structural diagram of the cartridge core assembly in Embodiment 3 of the present application.
Figure 14:
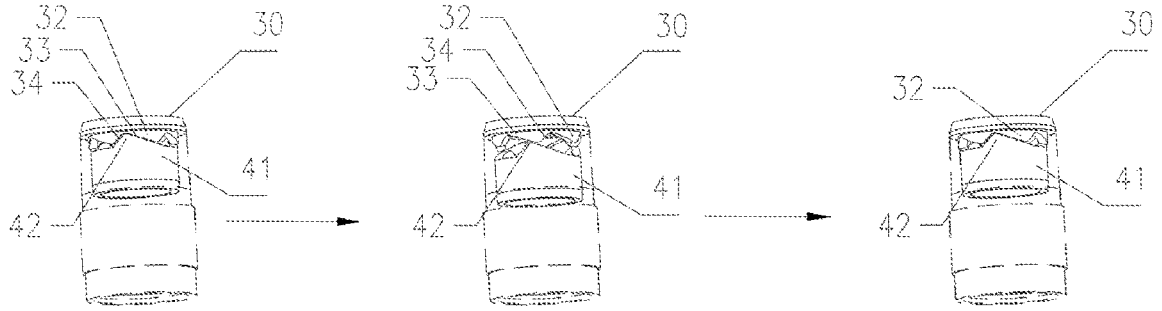
FIG. 14 is a first operation flowchart of the cartridge core assembly in Embodiment 3 of the present application.
Figure 15:
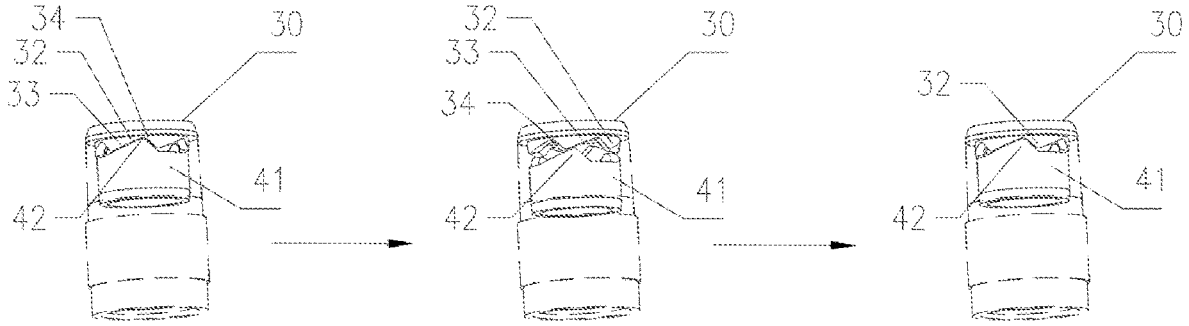
FIG. 15 shows a second operation flowchart of the cartridge core assembly in Embodiment 3 of the present application.
Figure 16:
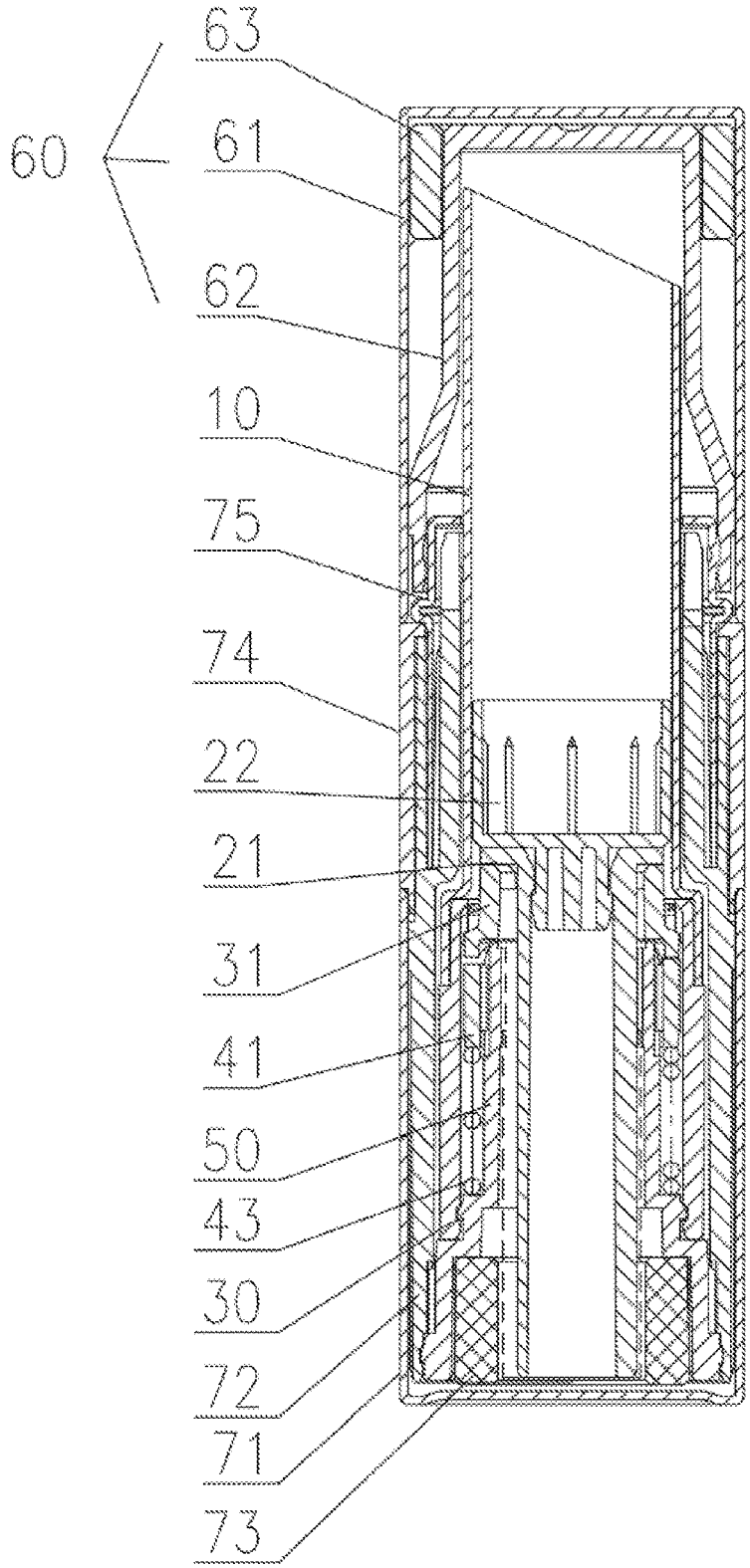
FIG. 16 is a schematic structural diagram of a cosmetic container in Embodiment 2 of the present application.
Figure 17:
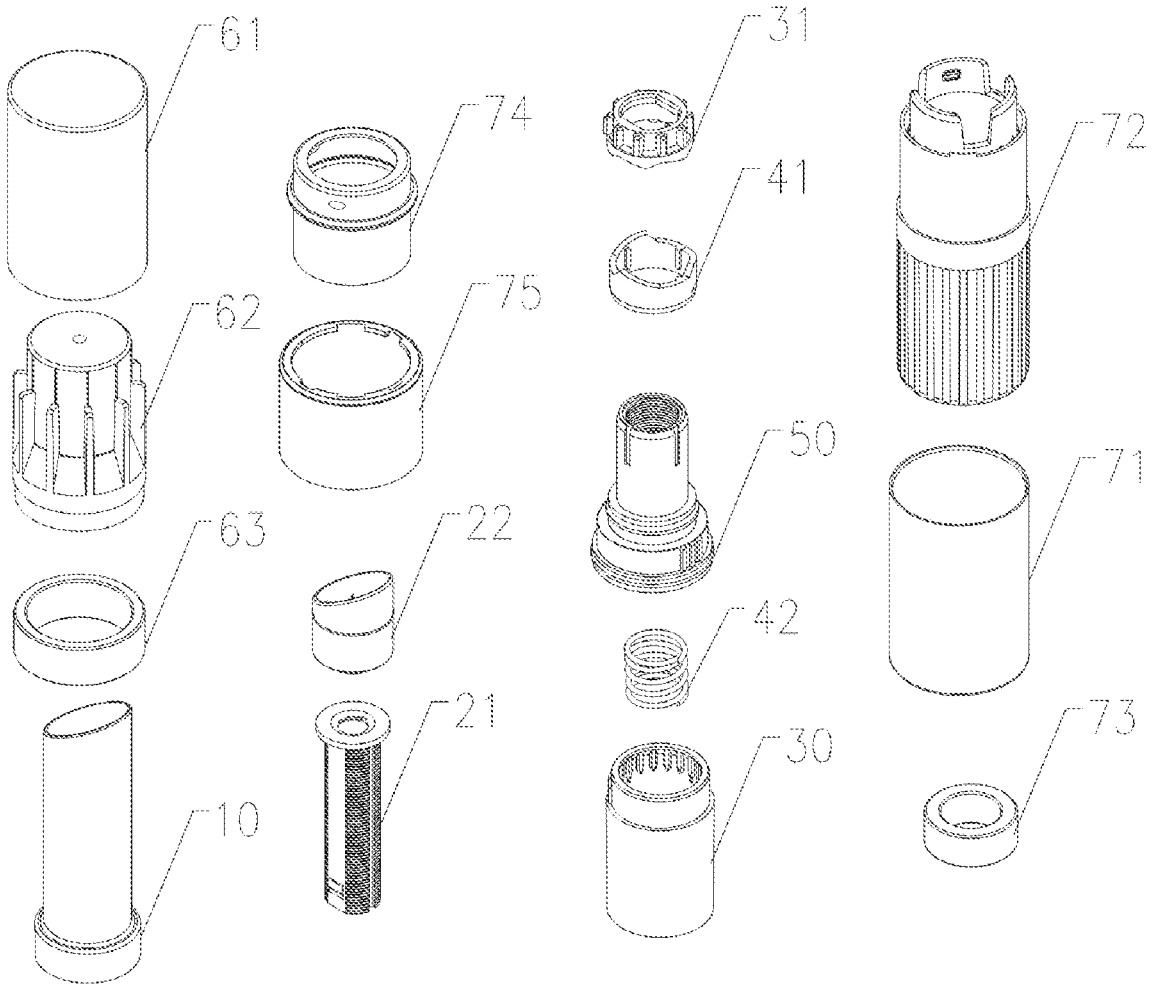
FIG. 17 is an exploded view of the cosmetic container in Embodiment 2 of the present application.
Figure 18:
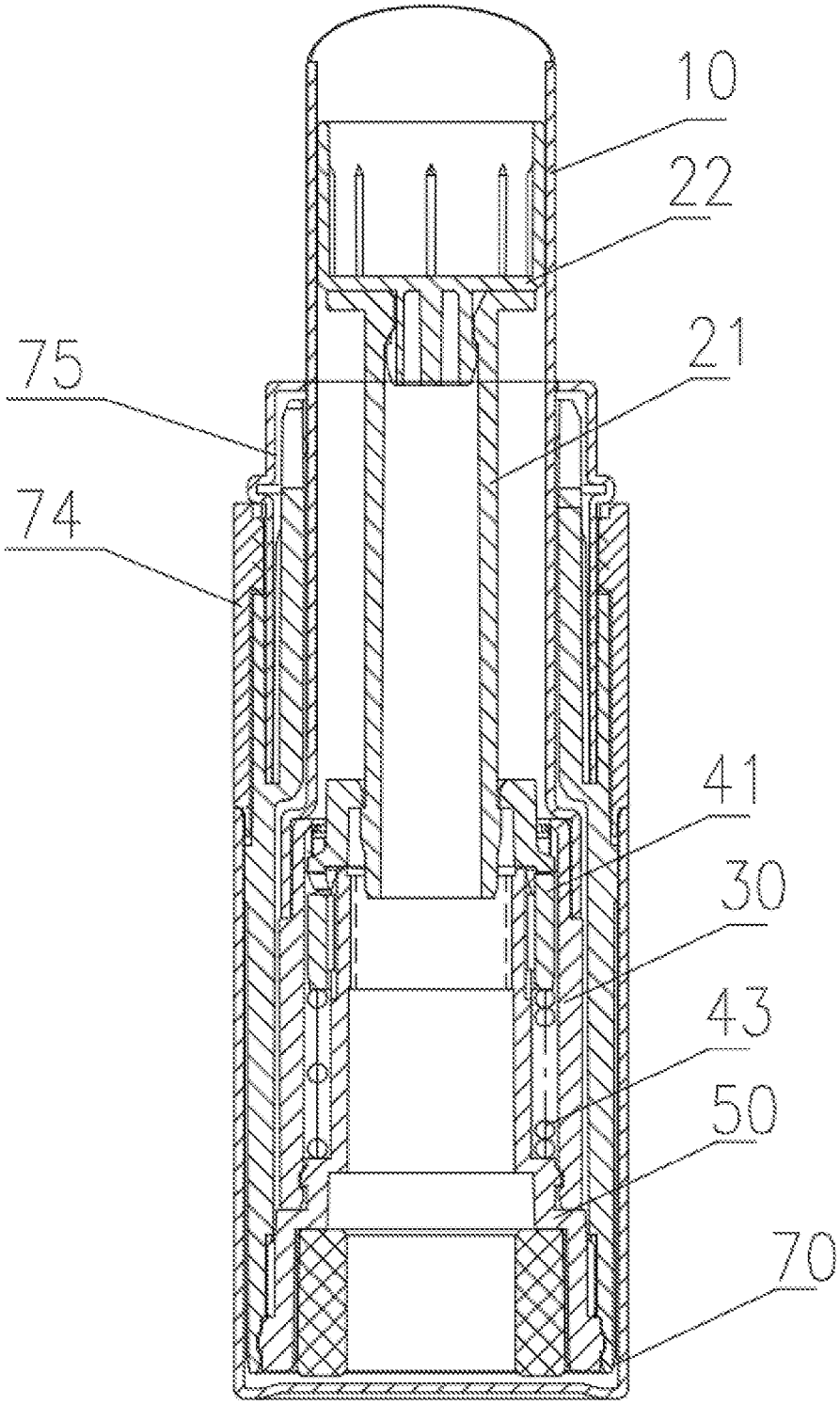
FIG. 18 is a diagram of the cosmetic container in Embodiment 2 of the present application in a first use state.

As shown in FIGS. 1-20, a cartridge core assembly comprises a cartridge 10, a screw barrel 20, a guide member 30, an elastic member 40, and a nut 50. The cartridge 10 is fixedly connected to the guide member 30, the screw barrel 20 and the nut 50 are screwed to each other, and the elastic member 40 is sleeved on the nut 50 in a circumferentially fixed manner. The guide member 30 comprises a plurality of first engagement teeth 32, the elastic member 40 comprises a plurality of second engagement teeth 42 that mesh with the first engagement teeth 32, and each tooth of at least one of the first engagement teeth 32 and the second engagement teeth 42 comprises a bottom surface, a first beveled surface 33 and a second beveled surface 34; and an angle between the first beveled surface 33 and the bottom surface is $\alpha_1$, an angle between the second beveled surface 34 and the bottom surface is $\alpha_2$, and the $\alpha_1$ and the $\alpha_2$ are both acute angles and the $\alpha_1$ is not equal to the $\alpha_2$. In the present application, the screw barrel 20 and the nut 50 are screwed to each other by means of threads; the screw barrel 20 is located inside the nut 50; the guide member 30 and the cartridge 10 are sleeved outside the screw barrel 20 and the nut 50; the nut 50 protrudes from the guide member 30; when the nut 50 rotates, the screw barrel 20 can be driven to move up and down along the cartridge 10, so that a cosmetic material inside the screw barrel 20 extends from or retracts into the cartridge; and the elastic member 40 is sleeved on an outside wall of the nut 50, and the elastic member 40 and the nut 50 are circumferentially fixed, that is, when the nut 50 rotates, the elastic member 40 can be driven to rotate synchronously. As shown in FIGS. 1 and 3, a rib is provided on an inside wall of the elastic member 40, a groove is provided in the outside wall of the nut 50, and when the elastic member 40 is sleeved on the nut 50, the rib is exactly mounted inside the groove, so that the elastic member 40 and the nut 50 are circumferentially fixed but axially movable. Of course, other ways may also be used to circumferentially fix the two, and for example, the elastic member and the nut are both provided with ribs that engaged with each other. During assembly, as shown in FIGS. 14 and 15, the first engagement teeth 32 on the guide member 30 mesh with the second engagement teeth 42 on the elastic member 40. During use, when the second engagement teeth 42 pass over the first engagement teeth 32, a sound will be generated, and a user can judge the angle of rotation by means of the sound, so as to more accurately control the process of operation of a product and to improve the user's sense of comfort of operation.

Each tooth of at least one of the first engagement teeth 32 and the second engagement teeth 42 comprising a bottom surface, a first beveled surface 33 and a second beveled surface 34 means that there are three cases as follows: first, each tooth of the first engagement teeth 32 comprises a bottom surface, a first beveled surface 33 and a second beveled surface 34, and the structure of each tooth of the second engagement teeth 42 is not defined; second, each tooth of the second engagement teeth 42 comprises a bottom surface, a first beveled surface 33 and a second beveled surface 34, and the structure of each tooth of the first engagement teeth 32 is not defined; and third, each tooth of the first engagement teeth 32 and each tooth of the second engagement teeth 42 comprise a bottom surface, a first beveled surface 33 and a second beveled surface 34.

Figure 6:
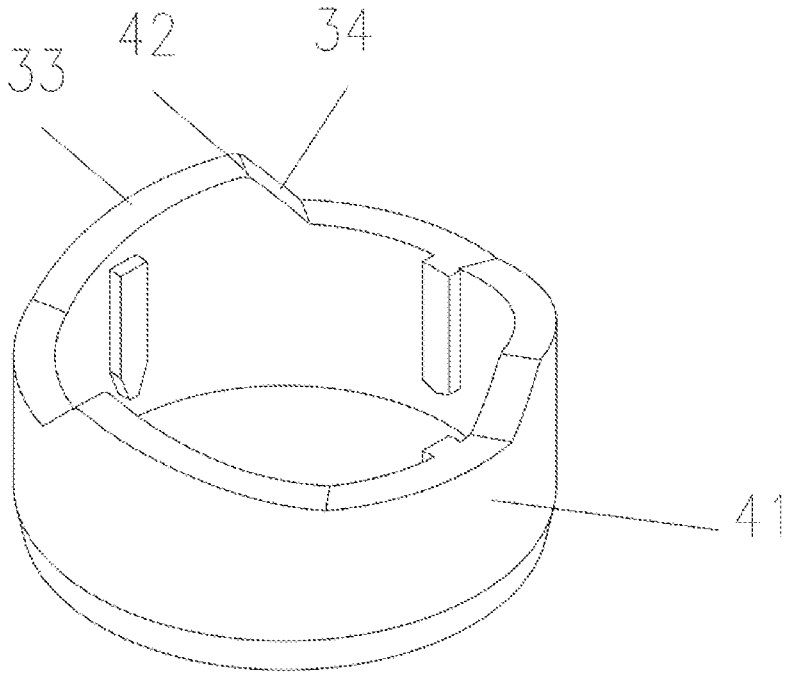
FIG. 6 is a schematic structural diagram of an engagement ring in Embodiment 2 of the present application.

As shown in FIGS. 3 and 6, taking the second engagement teeth 42 as an example for illustration, each tooth of the second engagement teeth 42 is a protrusion protruding upwardly in an axial direction from an upper surface of the elastic member 40, and the bottom surfaces of the second engagement teeth 42 are the upper surface at which the second engagement teeth 42 cover the elastic member 40. The first beveled surface 33 and the second beveled surface 34 are two slope surfaces, the angle between the first beveled surface 33 and the bottom surface is specifically an angle between a center axis of the first beveled surface 33 and a center axis of the bottom surface, the angle between the second beveled surface 34 and the bottom surface is specifically an angle between a center axis of the second beveled surface and the center axis of the bottom surface; $\alpha_1$ and $\alpha_2$ are both acute angles, that is, the first beveled surface and the second beveled surface are gradual slopes, thereby ensuring that the nut 50 can be rotated both clockwise and counterclockwise; and $\alpha_1$ is not equal to 2, that is, $\alpha_1$ is greater than $\alpha_2$ or $\alpha_1$ is less than $\alpha_2$, which can ensure that the first beveled surface and the second beveled surface have different slopes, so that the resistance forces to the nut are different when rotating clockwise and counterclockwise so as to meet the different requirements of customers.

The first engagement teeth 32 and the second engagement teeth 42 may have different structures, for example, each tooth of the first engagement teeth 32 comprises a bottom surface, a first beveled surface 33 and a second beveled surface 34, but each tooth of the second engagement teeth 42 is of an ordinary protrusion structure, and vice versa. Optionally, as shown in FIGS. 14 and 15, the first engagement teeth 32 have the same structure as the second engagement teeth 42, each of the first beveled surface 33 and the second beveled surface 34 has a planar or curved upper surface, and the $\alpha_1$ is less than the $\alpha_2$. In this embodiment, each tooth of the first engagement teeth 32 and each tooth of the second engagement teeth 42 comprise a bottom surface, a first beveled surface 33 and a second beveled surface 34. Each of the first beveled surface 33 and the second beveled surface 34 having a planar or curved upper surface means that each of the first beveled surface 33 and the second beveled surface 34 has a planar upper surface, or each of the first beveled surface 33 and the second beveled surface 34 has a curved upper surface, wherein the curved surface may be convex or concave; or the first beveled surface 33 has a planar upper surface and the second beveled surface 34 has a curved upper surface; or the first beveled surface 33 has a curved upper surface and the second beveled surface 34 have a planar upper surface. $\alpha_1$ being less than $\alpha_2$ means that the slope of the first beveled surface 33 is gentler than the slope of the second beveled surface 34, wherein $\alpha_1$ being less than $\alpha_2$ is defined herein for the purpose of clear illustration of the operation process of the cartridge core assembly instead of defining a structure, and in another embodiment, $\alpha_1$ being greater than $\alpha_2$ is also possible.

As shown in FIGS. 14 and 15, when the first engagement teeth 32 mesh with the second engagement teeth 42, the first beveled surfaces of the first engagement teeth 32 are abutted against the first beveled surfaces of the second engagement teeth 42, and the second beveled surfaces of the first engagement teeth 32 are abutted against the second beveled surfaces of the second engagement teeth 42. As shown in FIG. 14, in one implementation, when the nut 50 is rotated counterclockwise and the cosmetic material is screwed out, the elastic member 40 synchronously rotates counterclockwise, and the first beveled surfaces of the second engagement teeth 42 slide along the first beveled surfaces of the first engagement teeth 32 and gradually disengage therefrom. That is, the second engagement teeth 42 pass over the first engagement teeth 32 along the first beveled surfaces, and since the slope of the first beveled surface 33 is relatively gentle, a smaller torque is required to screw out the cosmetic material. When the second engagement teeth 42 pass over the first engagement teeth 32, the elastic member 40 recovers, so that the second engagement teeth 42 are again abutted against the first engagement teeth 32. Conversely, when the nut 50 is rotated clockwise and the cosmetic material is retracted into the cartridge 10, the second engagement teeth 42 pass over the first engagement teeth 32 along the second beveled surfaces, and since the slope of the second beveled surface 34 is relatively steep, a larger torque is required to retract the cosmetic material.

In another embodiment, as shown in FIG. 15, when the nut 50 is rotated counterclockwise and the cosmetic material is screwed out, the second beveled surfaces of the second engagement teeth 42 slide along the second beveled surfaces of the first engagement teeth 32 and gradually disengage therefrom. That is, the second engagement teeth 42 pass over the first engagement teeth 32 along the second beveled surfaces, and since the slope of the second beveled surface 34 is relatively steep, a larger torque is required to screw out the cosmetic material. Conversely, when the nut 50 is rotated clockwise and the cosmetic material is retracted into the cartridge 10, the second engagement teeth 42 pass over the first engagement teeth 32 along the first beveled surfaces, and since the slope of the first beveled surface 33 is relatively gentle, a smaller torque is required to retract the cosmetic material.

Figure 3:
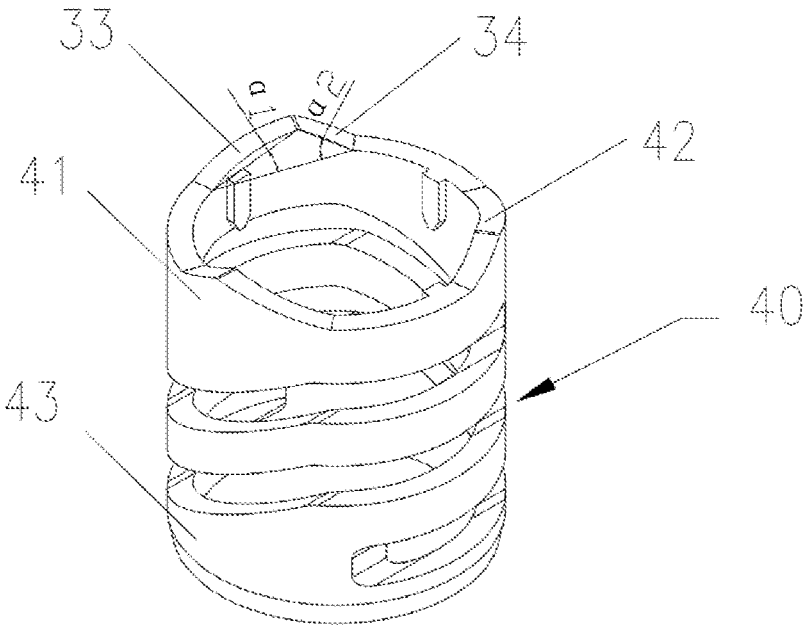
FIG. 3 is a schematic structural diagram of an elastic member in Embodiment 1 of the present application.
Figure 4:
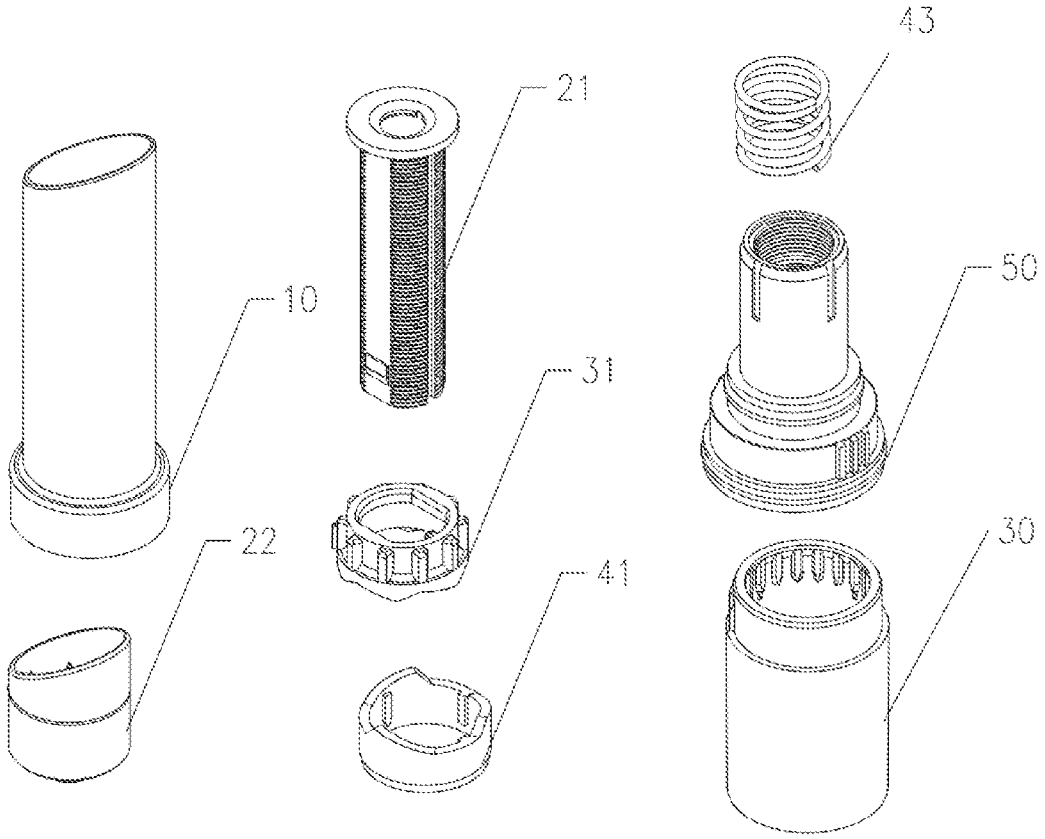
FIG. 4 is an exploded view of a cartridge core assembly in Embodiment 2 of the present application.
Figure 5:
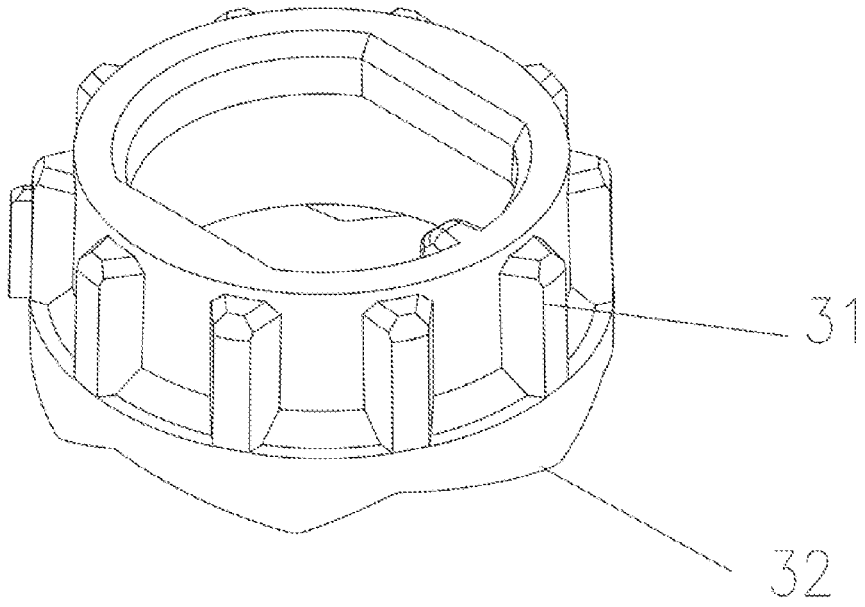
FIG. 5 is a schematic structural diagram of a ratchet ring in Embodiment 2 of the present application.

As shown in FIGS. 3-5, the first engagement teeth 32 are arranged uniformly and contiguously in a circumferential direction of the guide member 30, and the second engagement teeth 42 are arranged uniformly and spaced apart in a circumferential direction of the elastic member 40. The first engagement teeth 32 being arranged uniformly and contiguously in the circumferential direction of the guide member 30 means that adjacent first engagement teeth 32 are connected end to end, and all the first engagement teeth are of the same size. The second engagement teeth 42 being arranged uniformly and spaced apart in the circumferential direction of the elastic member 40 means that two adjacent second engagement teeth 42 are spaced apart by the same distance, and all the second engagement teeth are of the same size. During use, relatively speaking, the elastic member 40 is a moving member and the guide member 30 is a stationary member, and a smaller number of engagement teeth are distributed on the elastic member and a larger number of engagement teeth are distributed on the guide member, so that the stability of operation of the cartridge core assembly can be ensured.

The number of first engagement teeth 32 is N times the number of second engagement teeth 42, or the number of second engagement teeth 42 is N times the number of first engagement teeth 32, wherein N is an integer from 1 to 10. Optionally, the number of first engagement teeth 32 is twice the number of second engagement teeth 42, or the number of second engagement teeth 42 is twice the number of first engagement teeth 32. Optionally, as shown in FIGS. 3-5, six first engagement teeth 32 are provided and three second engagement teeth 42 are provided, or three first engagement teeth 32 are provided and six second engagement teeth 42 are provided. Such a distribution of the engagement teeth can not only ensure the stability of the cartridge core assembly during rotation, but can also make the cartridge core bring a regular bouncing hand feeling during rotation, which is easy to operate and control.

Figure 2:
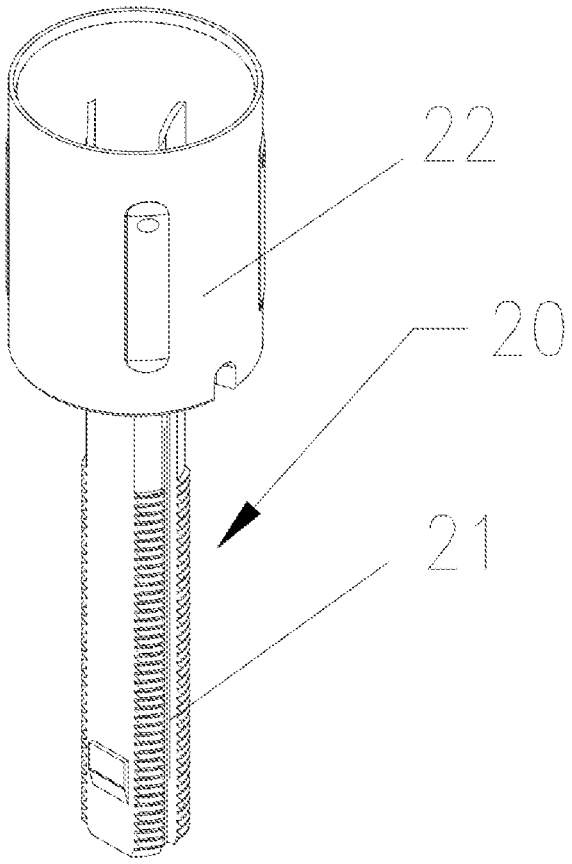
FIG. 2 is a schematic structural diagram of a screw barrel in Embodiment 1 of the present application.
Figure 7:
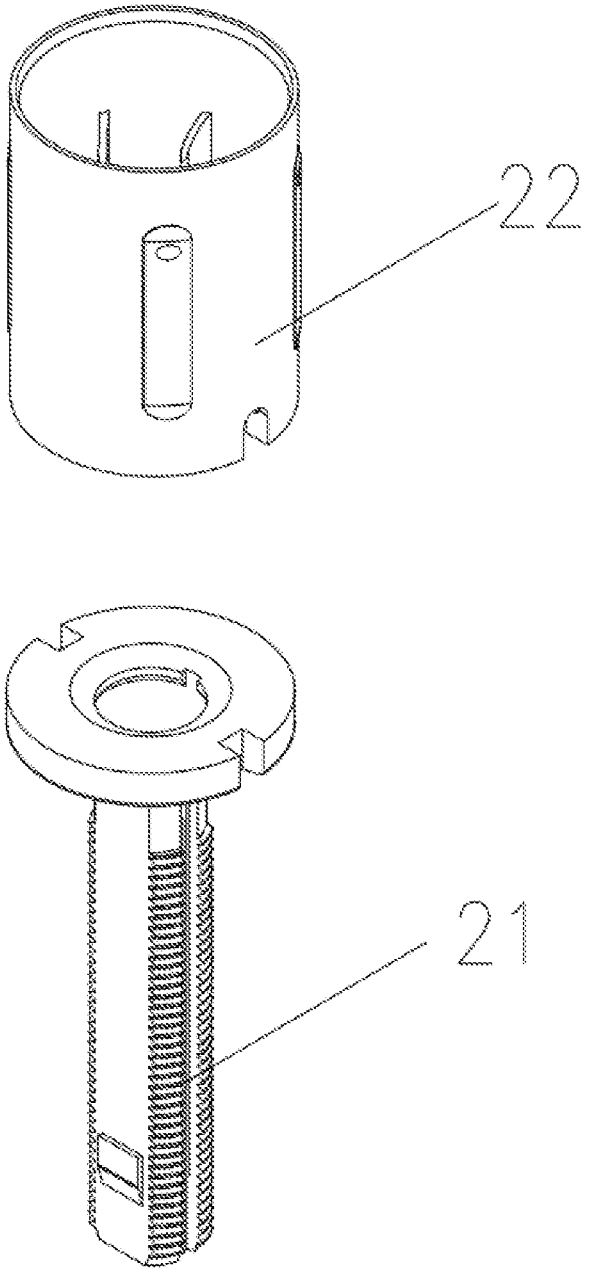
FIG. 7 is an exploded view of a screw barrel in Embodiment 2 of the present application.

As shown in FIGS. 1-2, in Embodiment 1, the screw barrel 20 comprises a screw 21 and a piston 22 that are fixedly connected, and the screw 21 and the piston 22 are an integrally molded part. Designing the screw barrel 20 to be of a one-piece structure can saves a set of molds, thereby reducing the manufacturing cost of the product. In Embodiment 2, as shown in FIGS. 4 and 7, the screw 21 and the piston 22 are separate parts. As shown in FIG. 4, the screw and the piston are designed as separate parts, and the screw 21 may be made of a first material with relatively large hardness so as to meet the overall strength requirements of the screw 21, and the piston 22 may be made of a second material that is relatively soft so as to meet the sealing requirements of the piston and to meet the temperature requirements for a filling material such as lipstick, lip balm, lip gloss. As shown in FIG. 7, both the screw 21 and the piston 22 may also be made of plastic as needed.

As shown in FIG. 1, in Embodiment 1, the first engagement teeth 32 are arranged on an inside wall of the guide member 30, that is, the first engagement teeth 32 are molded directly on the inside wall of the guide member 30, which reduces the manufacturing cost of the product, decreases the number of parts, and simplifies the mounting process. In Embodiment 2, as shown in FIGS. 4 and 5, the guide member 30 comprises a ratchet ring 31, the first engagement teeth 32 are arranged on a lower end face of the ratchet ring 31, and the ratchet ring 31 is fixedly mounted on the inside wall of the guide member 30 by means of a rib. In this embodiment, the ratchet ring 31 is an independent part, and the first engagement teeth 32 are designed on the ratchet ring 31 and the ratchet ring 31 is then mounted on the inside wall of the guide member 30, thereby facilitating the molding of the first engagement teeth 32 in a special form.

Figure 8:
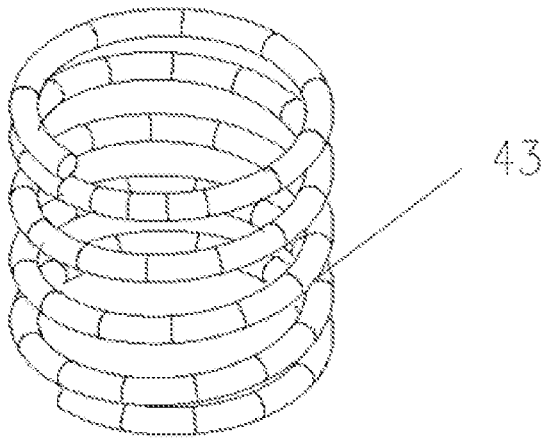
FIG. 8 is a schematic structural diagram of a spring made of metal in Embodiment 2 of the present application.
Figure 9:
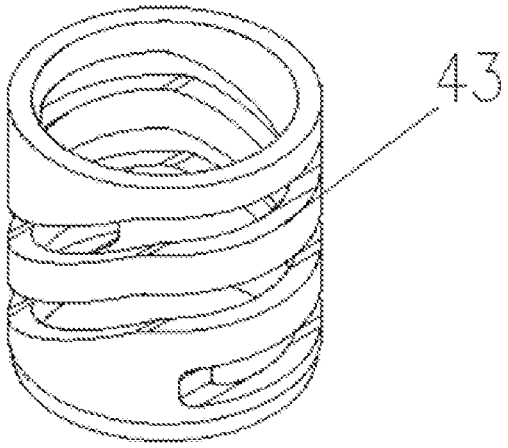
FIG. 9 is a schematic structural diagram of a spring made of plastic in Embodiment 2 of the present application.
Figure 10:
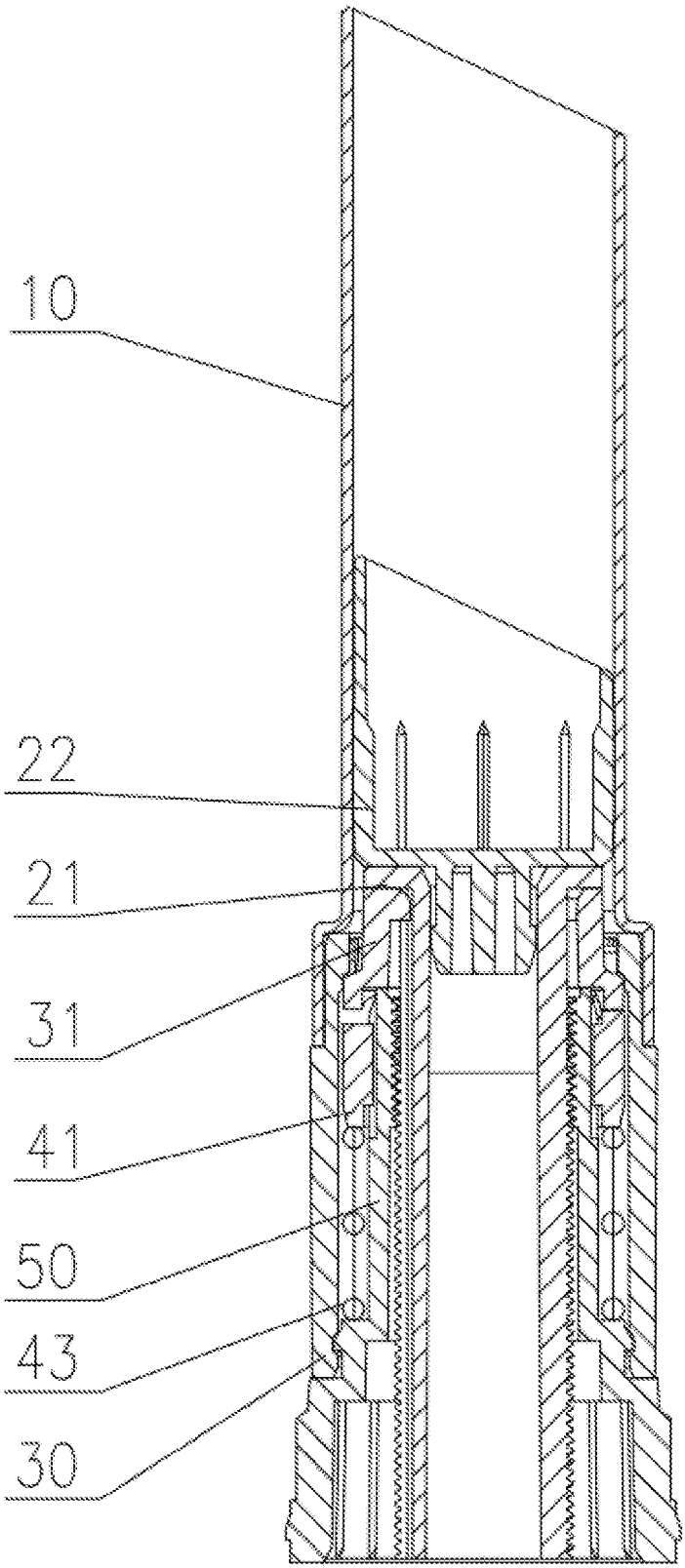
FIG. 10 is a schematic structural diagram of the cartridge core assembly in Embodiment 2 of the present application.

As shown in FIGS. 1 and 3, in Embodiment 1, the elastic member 40 comprises an engagement ring 41 and a spring 43, the second engagement teeth 42 are arranged on an upper end face of the engagement ring 41, the engagement ring 41 is mounted on the nut 50 by means of the rib in a circumferentially fixed manner, and the engagement ring 41 and the spring 43 are an integrally molded plastic part, that is, the elastic member 40 is an integrally molded plastic part, so that a set of molds are saved, thereby reducing the manufacturing cost of the product, and various parts of the product are made of plastic, for example, the screw barrel 20, the guide member 30, the elastic member 40 and a nut 50 are all made of polybutylene terephthalate (PBT), thereby facilitating recycling of the product. In Embodiment 2, as shown in FIGS. 4 and 6-9, the engagement ring 41 and the spring 43 are separate parts, and the spring 43 is sleeved on the nut 50. As shown in FIG. 8, the spring 43 may be a conventional metal spring, and the cartridge 10 is an aluminum cartridge, reducing the manufacturing cost of the product; or as shown in FIG. 9, the spring 43 may also be a plastic part to facilitate recycling of the product.

Figure 11:
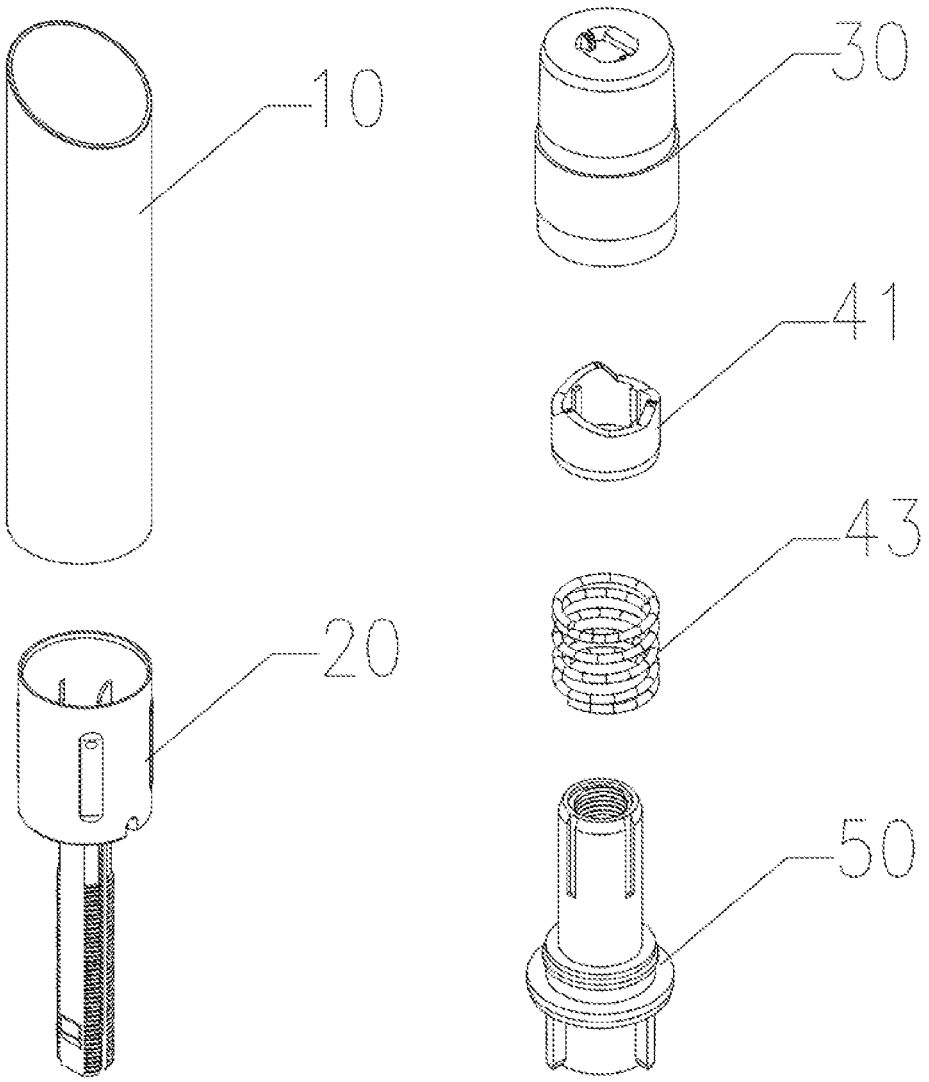
FIG. 11 is an exploded view of a cartridge core assembly in Embodiment 3 of the present application.
Figure 12:
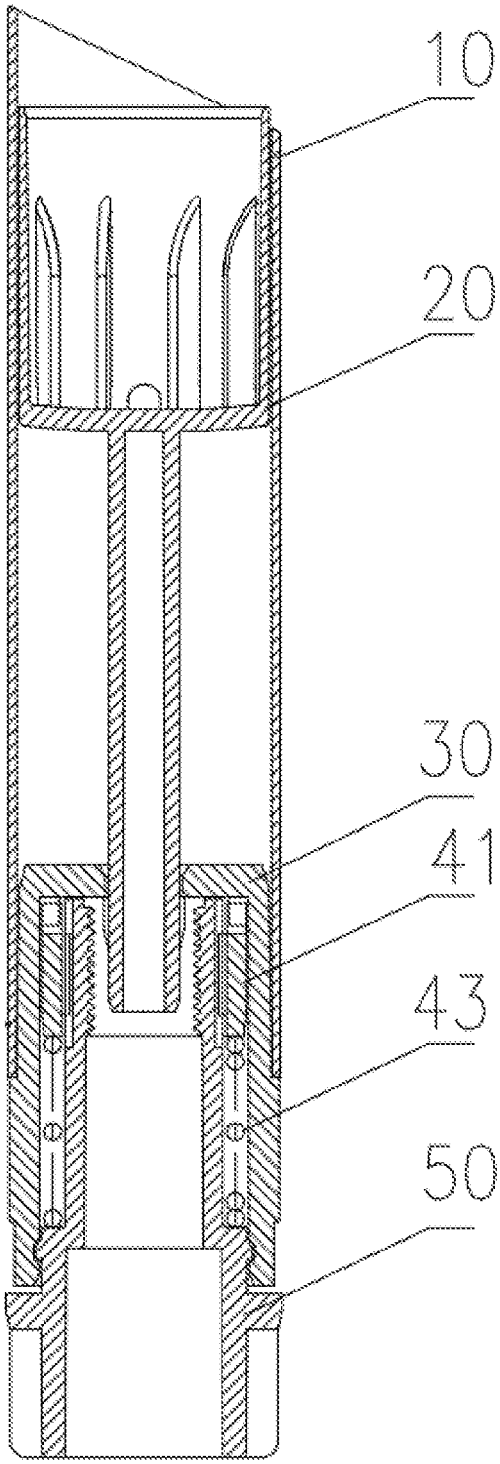
FIG. 12 is a first schematic structural diagrams of the cartridge core assembly in Embodiment 3 of the present application.

It should be noted that the screw barrel 20 is of a one-piece structure or a split structure, the guide member 30 is of a one-piece structure or a split structure, and the elastic member 40 is of one-piece structure or a split structure, so there are six different component structures for random matching. In Embodiment 1, as shown in FIG. 1, each of the screw barrel 20, the guide member 30 and the elastic member 40 is of a one-piece structure. In Embodiment 2, as shown in FIG. 4, each of the screw barrel 20, the guide member 30 and the elastic member 40 is of a split structure. In Embodiment 3, as shown in FIGS. 11-13, each of the screw barrel 20 and the guide member 30 is of a one-piece structure, and the elastic member 40 is of a split structure. Of course, there may be other matching ways, which will not be explained here.

Figure 19:
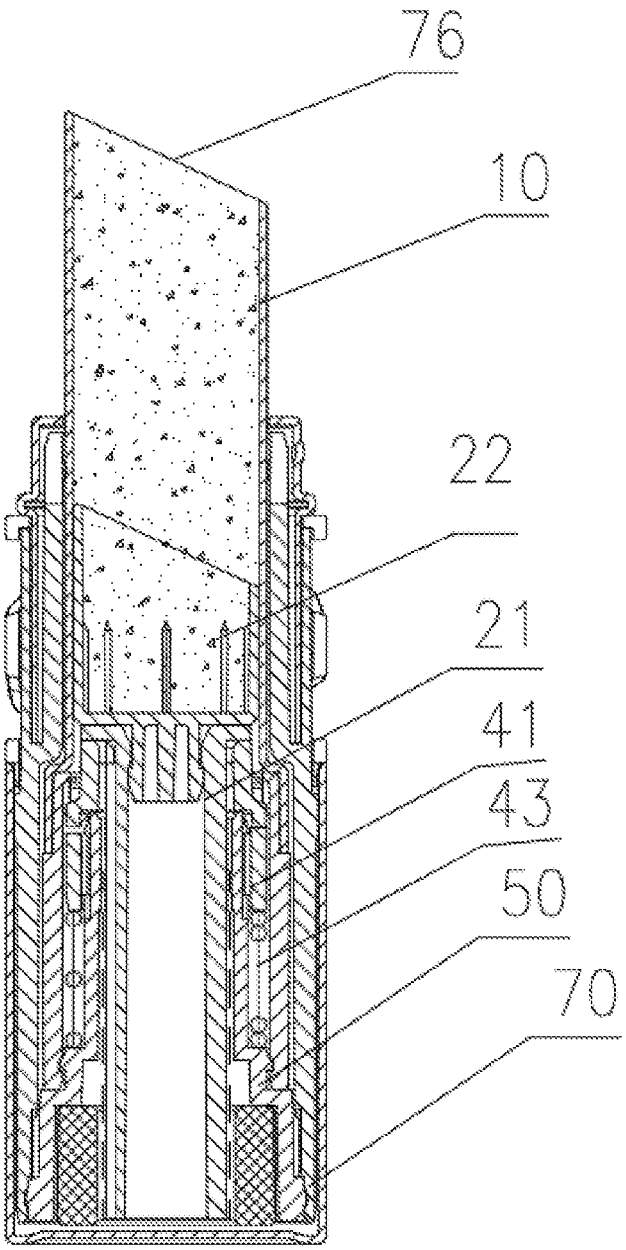
FIG. 19 is a diagram of a cosmetic container in Embodiment 2 of the present application in a second use state.
Figure 20:
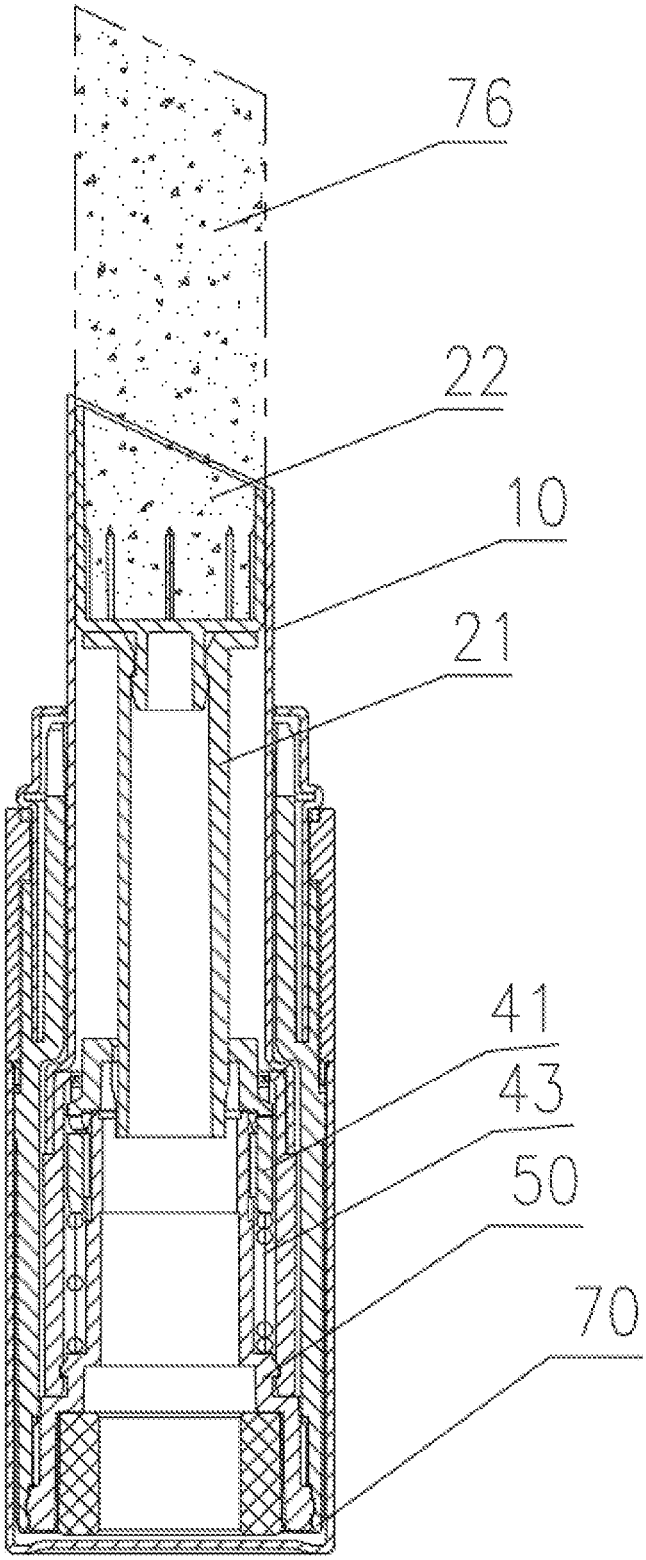
FIG. 20 is a diagram of a cosmetic container in Embodiment 2 of the present application in a third use state.

As shown in FIGS. 16-20, a cosmetic container comprises a cartridge core assembly, a cap assembly 60, and a base assembly 70, wherein the cartridge core assembly is mounted in the base assembly 70 such that the base assembly 70 is able to drive a nut 50 to rotate, and the cap assembly 60 removably covers the base assembly 70. The cap assembly 60 comprises an outer cap 61 and an inner cap 62 fixedly mounted in the outer cap 61, wherein a first vertical weight 63 is provided between the outer cap 61 and the inner cap 62; the base assembly 70 comprises an outer base 71, an inner base 72, a second vertical weight 73, an outer center ring 74, and an inner center ring 75; the inner base 72 is fixedly mounted in the outer base 71; the second vertical weight 73 is mounted in the nut 50; the nut 50 is connected to the inner base 72 by means of a rib in a circumferentially fixed manner; the inner center ring 75 is fixedly mounted in the outer center ring 74; the outer center ring 74 is mounted between the outer base 71 and the inner base 72; and the inner center ring 75 is fixedly sleeved on the cartridge 10. During use, a user takes off the cap assembly 60; as shown in FIG. 19, at this time, the cosmetic material 76 such as lipstick, lip balm, lip gloss is completely retracted in the cartridge 10, the user rotates the base assembly 70, the base assembly 70 drives the nut 50 to rotate, and the nut 50 drives the cosmetic material in the piston 22 to be screwed out for the user to use; and as shown in FIG. 20, at this time, the cosmetic material 76 is completely extended out of the cartridge 10. The user may screw out the cosmetic material to different heights as needed.

It should be pointed out that for a person of ordinary skill in the art, several modifications and improvements can be made without departing from the concept of the present application, and these modifications and improvements should all fall into the scope of protection of the present application. Therefore, the scope of protection of the present application shall be subject to the claims.

The invention claimed is:

1. A cartridge core assembly, comprising a cartridge (10), a screw barrel (20), a guide member (30), an elastic member (40), and a nut (50), wherein the cartridge (10) is fixedly connected to the guide member (30), the screw barrel (20) and the nut (50) are screwed to each other, and the elastic member (40) is sleeved on the nut (50) in a circumferentially fixed manner; the guide member (30) comprises a plurality of first engagement teeth (32), the elastic member (40) comprises a plurality of second engagement teeth (42) that mesh with the first engagement teeth (32), and each tooth of at least one of the first engagement teeth (32) and the second engagement teeth (42) comprises a bottom surface, a first beveled surface (33) and a second beveled surface (34); and an angle between the first beveled surface (33) and the bottom surface is $\alpha 1$, an angle between the second beveled surface (34) and the bottom surface is $\alpha 2$, and the $\alpha 1$ and the $\alpha 2$ are both acute angles and the $\alpha 1$ is not equal to the $\alpha 2$.

2. The cartridge core assembly according to claim 1, wherein the first engagement teeth (32) have the same structure as the second engagement teeth (42), each of the first beveled surface (33) and the second beveled surface (34) has a planar or curved upper surface, and the $\alpha 1$ is less than the $\alpha 2$.

3. The cartridge core assembly according to claim 2, wherein the screw barrel (20) comprises a screw (21) and a piston (22) that are fixedly connected, and the screw (21) and the piston (22) are an integrally molded part, or the screw (21) and the piston (22) are separate parts.

4. The cartridge core assembly according to claim 2, wherein the first engagement teeth (32) are arranged on an inside wall of the guide member (30); or the guide member (30) comprises a ratchet ring (31), the first engagement teeth (32) are arranged on a lower end face of the ratchet ring (31), and the ratchet ring (31) is fixedly mounted on the inside wall of the guide member (30) by means of a rib.

5. The cartridge core assembly according to claim 2, wherein when the first engagement teeth (32) mesh with the second engagement teeth (42), the first beveled surfaces of the first engagement teeth (32) are abutted against the first beveled surfaces of the second engagement teeth (42), and the second beveled surfaces of the first engagement teeth (32) are abutted against the second beveled surface of the second engagement teeth (42); and when a cosmetic material is screwed out, the first beveled surfaces of the second engagement teeth (42) slide along the first beveled surfaces of the first engagement teeth (32) and gradually disengage therefrom, or when a cosmetic material is screwed out, the second beveled surfaces of the second engagement teeth (42) slide along the second beveled surfaces of the first engagement teeth (32) and gradually disengage therefrom.

6. The cartridge core assembly according to claim 5, wherein the screw barrel (20) comprises a screw (21) and a piston (22) that are fixedly connected, and the screw (21) and the piston (22) are an integrally molded part, or the screw (21) and the piston (22) are separate parts.

7. The cartridge core assembly according to claim 5, wherein the first engagement teeth (32) are arranged on an inside wall of the guide member (30); or the guide member (30) comprises a ratchet ring (31), the first engagement teeth (32) are arranged on a lower end face of the ratchet ring (31), and the ratchet ring (31) is fixedly mounted on the inside wall of the guide member (30) by means of a rib.

8. The cartridge core assembly according to claim 1, wherein the first engagement teeth (32) are arranged uniformly and contiguously in a circumferential direction of the guide member (30), and the second engagement teeth (42) are arranged uniformly and spaced apart in a circumferential direction of the elastic member (40).

9. The cartridge core assembly according to claim 8, wherein the screw barrel (20) comprises a screw (21) and a piston (22) that are fixedly connected, and the screw (21) and the piston (22) are an integrally molded part, or the screw (21) and the piston (22) are separate parts.

10. The cartridge core assembly according to claim 8, wherein the first engagement teeth (32) are arranged on an inside wall of the guide member (30); or the guide member (30) comprises a ratchet ring (31), the first engagement teeth (32) are arranged on a lower end face of the ratchet ring (31), and the ratchet ring (31) is fixedly mounted on the inside wall of the guide member (30) by means of a rib.

11. The cartridge core assembly according to claim 1, wherein the number of first engagement teeth (32) is N times the number of second engagement teeth (42), or the number of second engagement teeth (42) is N times the number of first engagement teeth (32), wherein N is an integer from 1 to 10.

12. The cartridge core assembly according to claim 11, wherein the screw barrel (20) comprises a screw (21) and a piston (22) that are fixedly connected, and the screw (21) and the piston (22) are an integrally molded part, or the screw (21) and the piston (22) are separate parts.

13. The cartridge core assembly according to claim 11, wherein the first engagement teeth (32) are arranged on an inside wall of the guide member (30); or the guide member (30) comprises a ratchet ring (31), the first engagement teeth (32) are arranged on a lower end face of the ratchet ring (31), and the ratchet ring (31) is fixedly mounted on the inside wall of the guide member (30) by means of a rib.

14. The cartridge core assembly according to claim 11, wherein six first engagement teeth (32) are provided and three second engagement teeth (42) are provided, or three first engagement teeth (32) are provided and six second engagement teeth (42) are provided.

15. The cartridge core assembly according to claim 14, wherein the screw barrel (20) comprises a screw (21) and a piston (22) that are fixedly connected, and the screw (21) and the piston (22) are an integrally molded part, or the screw (21) and the piston (22) are separate parts.

16. The cartridge core assembly according to claim 14, wherein the first engagement teeth (32) are arranged on an inside wall of the guide member (30); or the guide member (30) comprises a ratchet ring (31), the first engagement teeth (32) are arranged on a lower end face of the ratchet ring (31), and the ratchet ring (31) is fixedly mounted on the inside wall of the guide member (30) by means of a rib.

17. The cartridge core assembly according to claim 1, wherein the screw barrel (20) comprises a screw (21) and a piston (22) that are fixedly connected, and the screw (21) and the piston (22) are an integrally molded part, or the screw (21) and the piston (22) are separate parts.

18. The cartridge core assembly according to claim 1, wherein the first engagement teeth (32) are arranged on an inside wall of the guide member (30); or the guide member (30) comprises a ratchet ring (31), the first engagement teeth (32) are arranged on a lower end face of the ratchet ring (31), and the ratchet ring (31) is fixedly mounted on the inside wall of the guide member (30) by means of a rib.

19. The cartridge core assembly according to claim 1, wherein the elastic member (40) comprises an engagement ring (41) and a spring (43), the second engagement teeth (42) are arranged on an upper end face of the engagement ring (41), the engagement ring (41) is mounted on the nut (50) by means of a rib in a circumferentially fixed manner, the engagement ring (41) and the spring (43) are an integrally molded plastic part, or the engagement ring (41) and the spring (43) are separate parts, and the spring (43) is sleeved on the nut (50).

20. A cosmetic container, comprising the cartridge core assembly according to claim 1, a cap assembly (60), and a base assembly (70), wherein the cartridge core assembly is mounted in the base assembly (70) such that the base assembly (70) is able to drive the nut (50) to rotate, and the cap assembly (60) removably covers the base assembly (70).

* * * * *